US007059093B2

(12) United States Patent
Akers

(10) Patent No.: US 7,059,093 B2
(45) Date of Patent: Jun. 13, 2006

(54) METHODS, SYSTEMS, KITS, AND FABRICATIONS OF ACOUSTIC-PANEL-BASED BUILD-IN WALL STRUCTURES PROVIDING FOR VARIABLE LINEAR SPANS

(75) Inventor: Frederick Jaye Akers, Orlando, FL (US)

(73) Assignee: Feature Presentation, Inc., Orlando, FL (US)

( * ) Notice: Subject to any disclaimer, the term of this patent is extended or adjusted under 35 U.S.C. 154(b) by 126 days.

(21) Appl. No.: 10/337,936

(22) Filed: Jan. 6, 2003

(65) Prior Publication Data

US 2004/0128944 A1 Jul. 8, 2004

(51) Int. Cl.
*E04B 2/00* (2006.01)

(52) U.S. Cl. ..... 52/506.06; 52/270

(58) Field of Classification Search ..... 52/745.12, 52/144, 145, 79.1, 79.7, 79.13, 220.1, 220.2, 52/220.7, 287.1, 238.1, 239, 65, 506.06, 52/508, 768, 309.7, 309.8, 309.2, 784.1, 52/270, 746.1, 747.1, 220.3; 181/294, 284, 181/291, 290, 292, 179; 104/35, 46, 4
See application file for complete search history.

(56) References Cited

U.S. PATENT DOCUMENTS

| | | | | | |
|---|---|---|---|---|---|
| 2,150,344 | A | * | 3/1939 | Schilling | 52/144 |
| 3,080,022 | A | * | 3/1963 | Mote | 52/405.4 |
| 3,305,993 | A | * | 2/1967 | Nelsson | 52/481.1 |
| 3,343,314 | A | * | 9/1967 | Smith | 52/145 |
| 3,566,559 | A | | 3/1971 | Dickson | |
| 3,685,220 | A | | 8/1972 | Morrison | |
| 3,753,328 | A | | 8/1973 | Papsco | |
| 3,852,926 | A | | 12/1974 | Papsco | |
| 3,990,205 | A | | 11/1976 | Davis | |
| 4,028,855 | A | | 6/1977 | Prewer | |
| 4,094,113 | A | | 6/1978 | Good | |
| 4,112,643 | A | | 9/1978 | Decker | |
| 4,204,375 | A | | 5/1980 | Good | |
| 4,245,442 | A | | 1/1981 | Durham | |
| 4,891,920 | A | * | 1/1990 | Pingston | 52/145 |
| 4,942,713 | A | | 7/1990 | Jackson | |
| 4,967,529 | A | * | 11/1990 | L'Heureux | 52/390 |
| 5,501,754 | A | * | 3/1996 | Hiraguri | 156/71 |
| 5,822,928 | A | | 10/1998 | Maxwell et al. | |
| 5,890,323 | A | | 4/1999 | Errato | |
| 5,896,710 | A | * | 4/1999 | Hoyle | 52/144 |
| 6,378,252 | B1 | * | 4/2002 | Bernard et al. | 52/144 |
| 6,640,507 | B1 | * | 11/2003 | Leconte | 52/145 |
| 6,668,504 | B1 | * | 12/2003 | Hughart | 52/481.1 |

* cited by examiner

OTHER PUBLICATIONS

Owens Corning Pub. No. 15-BL-44852-B Visionaire FX Theaters—The Connoisseur Model (Date unknown).

*Primary Examiner*—Ramon O Ramirez
(74) *Attorney, Agent, or Firm*—Joseph Fischer; Beusse, Wolter, Sanks, Mora & Maire, P.A.

(57) ABSTRACT

Methods, kits, systems and fabrications of home theater presentation rooms, audio listening rooms, and other types of rooms having acoustical panels (collectively, "acoustical-paneled rooms") are arranged inside existing wall structures, such as in a house. The component acoustical panels and bridging structures, such as vertically oriented columns, are arranged and constructed to permit a particular assemblage of such components to be able to extend across a range of wall widths, or spans. This is achieved by having the panels variably spaced from the centerline of the columns, to form gaps, with the columns nonetheless covering the edges of such panels and the gaps. In preferred embodiments, a particularly strong and easily assembled column assembly is utilized.

16 Claims, 13 Drawing Sheets

METHODS, SYSTEMS, KITS, AND FABRICATIONS OF ACOUSTIC-PANEL-BASED BUILD-IN WALL STRUCTURES PROVIDING FOR VARIABLE LINEAR SPANS

AUTHORIZATION

A portion of the disclosure of this patent document contains material which is subject to copyright protection. The copyright owner has no objection to the facsimile reproduction by any one of the patent document or the patent disclosure, as it appears in the Patent and Trademark Office patent file or records, but otherwise reserves all copyright rights whatsoever.

BACKGROUND OF THE INVENTION

1. Field of Invention

The field of invention relates to the assembly and structure of sheetlike panels, particularly acoustical panels, that are assembled parallel to an existing wall, that are laterally related, that have a bridger structure, such as a column or column assembly, hiding the juncture of such panels, and where the entire build-in wall provides for construction of a range of linear wall spans without the need to cut said panels.

2. Description of the Related Art

One related art is the field of construction methods to assemble paneled walls inside existing structural walls. A second related art is the construction of theaters.

The following are U.S. patents that may be found to help define the scope of knowledge of persons skilled in the relevant related arts: U.S. Pat. Nos. 3,852,926; 3,753,328; 3,566,559; 4,942,713; 4,204,375; 4,028,855; 4,094,113; 3,685,220; 5,822,928; 5,890,323; 3,990,205; 4,112,643; and 4,245,442.

None of the above references have been directed to the production of kits, that is, assemblies of components, that facilitate the design and installation of home theater presentation rooms, audio listening rooms, and other types of rooms having acoustical panels (collectively, "acoustical-paneled rooms") arranged inside an existing wall structure. The present invention is directed to this, and achieves this in a number of innovative ways, providing for assemblies of components that can cover a range of spans of wall widths, and providing, in preferred embodiments, easily erected structures having superior structural integrity.

In addition to the above patents, the following books provide different carpentry approaches to construction, and to architectural features such as for columns, that are useful sources of background information for the present invention:

*Building Construction Illustrated*, 3rd Edition, Francis D. K. Ching & Cassandra Adams, John Wiley & Sons, 2001.

*The Elements of Style*, revised edition, Stephen Calloway, Ed., Simon & Schuster, 1996.

All patents, patent applications, books, articles and other publications discussed or cited herein are incorporated by reference to the same extent as if each individual patent, patent application, book, article and other publication was specifically and individually set forth in its entirety.

SUMMARY AND OBJECTS OF THE INVENTION

The present invention is directed to the building of home theater presentation rooms, audio listening rooms, and other types of rooms having acoustical panels (collectively, "acoustical-paneled rooms") arranged inside an existing wall structure. This answers a need in the field to have a method of construction, and an assemblage of components, that are utilized to construct a home theater, or other type of acoustical-paneled room, within existing rooms that have a range of room widths and a range of room lengths.

More particularly, the present invention provides an effective approach to producing a kit or other assemblage of components to erect a sound-absorbing wall, or an entire sound-absorbing room, where such wall or room is attached to existing interior structural wall(s). Advantageously, the present invention can cover a range of linear span of existing walls with no, or with minimal cutting, of acoustical panels to fit into a particular existing span of structural wall. This is achieved by including a bridging column, a bridging column assembly, or other bridging means (collectively, "bridger structure"), that provides a lateral space behind which the vertical edges of adjacent panels are covered. Thus, by proper positioning of any such bridger structure along the existing structural wall, most or all acoustical panels along the new, acoustical wall, are positioned without the need to cut such panels.

Thus, one object of the present invention is to provide a kit of components for installation of one or more walls of an acoustical-paneled room, where at least one column that covers the edges of adjacent acoustical panels also covers a gap, or space, coplanar with the panels. The panel edges are positioned into that gap, or space, a distance that is determined by the linear dimension of a particular span of wall to be covered by such panels.

Another object of the present invention is to provide a kit of components for installation of one or more walls of an acoustical-paneled room, where two or more columns that cover the edges of adjacent acoustical panels each also covers a gap, or space, coplanar with the panels. The panel edges are positioned into that gap, or space, a distance that is determined by the linear dimension of a particular span of wall to be covered by such panels. That is, if a wall section's linear dimension is relatively short in regard to the span that the kit can cover, more of each gap will be filled by the panels, to effectively shorten the span between the columns. Once calculations are made and the column positions are determined for a particular span of wall, the edges of adjacent acoustical panels are placed into position to fill a determined portion of the total gap. That portion that is filled by the panels will be greater for shorter wall spans, all other factors being equal.

Another object of the present invention is to provide a method of fabrication and erection of one or more walls of an acoustical-paneled room, where the placement of at least one column that covers the edges of adjacent acoustical panels, behind which exists a gap, coplanar with the panels and into which the edges are positioned, is determined by the linear dimension of a particular span of wall to be covered by such panels.

Another object of the present invention is to provide a method of fabrication and erection of one or more walls of a home theater presentation room, where the placement of two or more columns that cover the edges of adjacent acoustical panels, wherein behind each such column is a gap, coplanar with the panels and into which the edges are positioned. The panel edges are positioned into that gap, or space, a distance that is determined by the linear dimension of a particular span of wall to be covered by such panels. That is, if a wall section's linear dimension is relatively short in regard to the span that the kit can cover, more of each gap will be filled by the panels, to effectively shorten the span between the columns. Once calculations are made and the column positions are determined for a particular span of wall, the edges of adjacent acoustical panels are placed into position to fill a determined portion of the total gap. That portion that is filled by the panels will be greater for shorter wall spans, all other factors being equal.

Another object of the present invention is to provide constructed build-in walls for an acoustical-paneled room made by the methods and/or kits described herein.

Another object of the present invention is to provide a range of possible fabrications of columns and column assemblies that are readily utilizable to define a gap into which the edge sections of panels are inserted to a position based on the dimension of the wall to be covered.

Another object of the present invention is to provide kit of components for installation of all walls of an acoustical-paneled room, and additionally to include seats, a screen, a projector to project an image on the screen, speakers, and related connections and electronic devices to provide a complete home theater presentation room.

It is to be understood that the foregoing summary and objects, and the following more detailed descriptions, are exemplary and explanatory only and are not to be viewed as being restrictive of the present invention as claimed. The above and other objects, features and advantages of the present invention will become apparent after a review of the following detailed description of the disclosed embodiments and the appended claims.

MORE DETAILED DESCRIPTION OF THE INVENTION

Definitions

Figure 1:
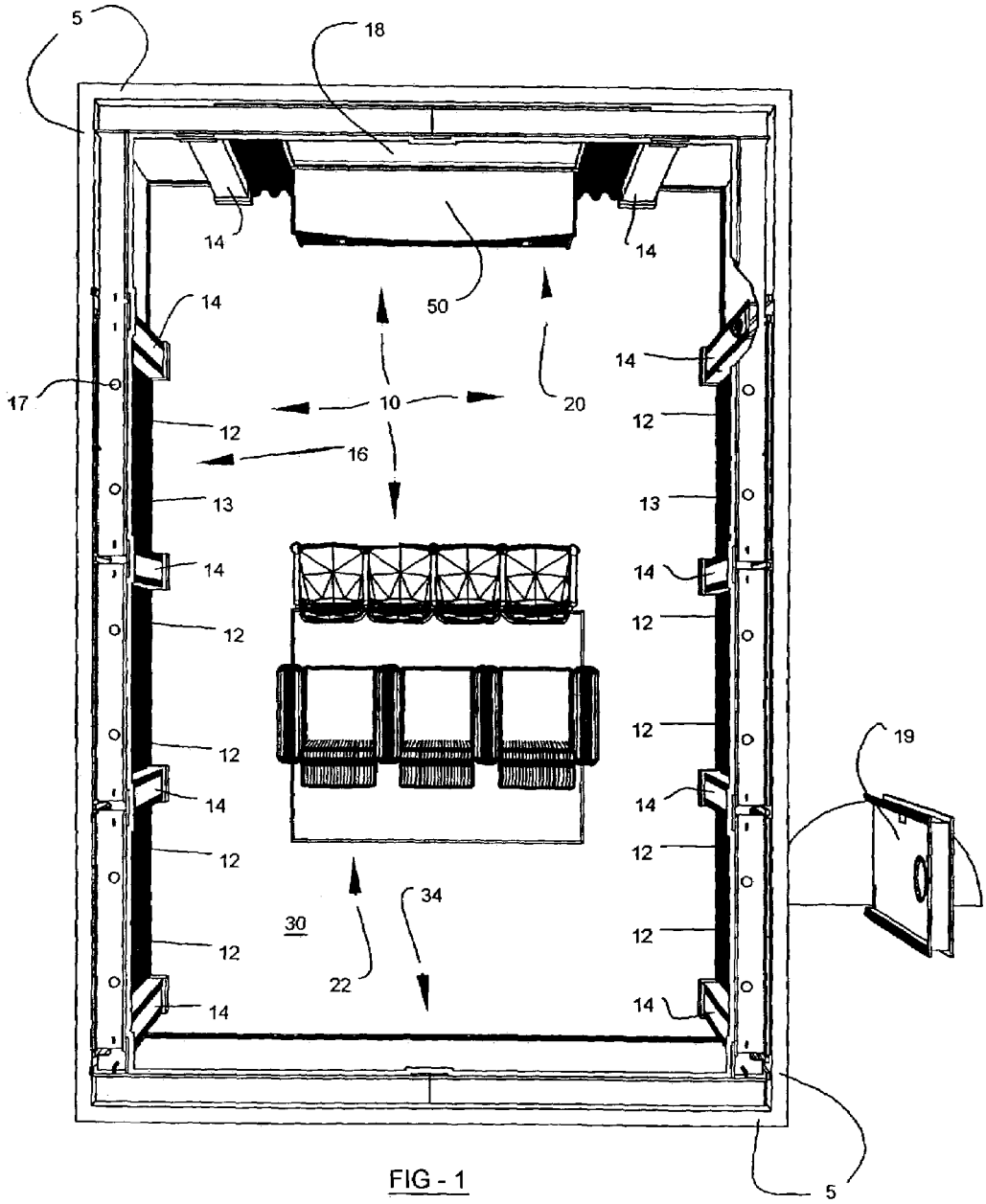
FIG. 1 provides an overhead perspective view of one layout of a completed home theater presentation room according to the present invention, with acoustical panels fitted between columns along the side walls.

As used herein, the term "acoustical panel" and "acoustic panel" are used to denote the class of planar, substantially flat panels that are recognized to have special sound-absorbing or sound-reflective properties as compared to standard wall coverings such as gypsum wall board, plaster, and wood paneling.

As used herein, the term "bridger structure" is used to denote a physical overlying covering which is placed over the edges of two adjacent sheetlike panels, and which is used to structurally connect such panels, and/or to hide the juncture of such panels, and/or to hide the gap that separates, or exists between, such adjacent panels edges.

As used herein, the term "build-in" is used to denote a wall that is build within an existing structural wall.

As used herein, the term "column assembly" is used to denote a type of bridger structure for covering the edges of two coplanar panels, and any gap between such edges, where the column assembly is comprised of two or more distinct components that are assembled together at the site of erection of such panels. As used herein, "column" is used to denote a unitary bridger structure to join edges of two coplanar panels. However, when used in the present disclosure, "column," based on its context and reference to the appurtenant figures, also may be taken to refer to a "column assembly" without creating ambiguity. Also, in certain embodiments, the column assembly is taken to include the column bracket, or its functional equivalence in a unitary piece having the combined function of several components identified and described herein.

As used herein, the term "juxtaposing" is used to denote the putting side by side, or close together, of the items so referred to, in a linear, substantially coplanar arrangement.

As used herein, the term "secure" when used as a verb is taken to mean any means now known or later in existence, and known to those of ordinary skill in the art, to attach one piece to another. Without being limiting, such means include nailing, screwing, gluing, and attaching with adhesive caulk.

As used herein, the term "substantially coplanar" is taken to mean that the planes of the panels so described preferably fall within ⅛ inch of each other, overall, less preferably within ¼ inch of each other, overall, and less preferably, within ½ inch of each other, overall. In preferred uses of the term, the panels so described form a uniformly flat wall to an average viewer of the structure.

Other terms not specifically defined herein should be given their plain meanings, or a meaning as clearly inferable from usage in this specification, including the figures and the claims.

Discussion of Figures

Referring to the drawings, wherein like reference numerals represent like parts throughout the various drawing figures, reference numeral 10 is generally directed to a completed home theater presentation room, or other acoustical-paneled room, or a wall that is substantially or mostly covered with acoustical panels according to the present invention methods, kits, and/or fabrications.

FIG. 1 provides an overhead perspective view of one layout of a completed home theater presentation room, 10, according to the present invention. The structures of the home theater presentation room are built within four structural walls, 5, which typically have different dimensions from one installation to the next. In some installations, an installer will need to build one or more new structural walls to reduce a larger room into two or more rooms, one of which is suitable for an acoustical-paneled room of the present invention. Whether or not this is the case, it is the variation in dimensions of the structural walls of the room into which the home theater presentation room is to be installed, from one installation to the next, that the present invention addresses and facilely resolves.

In die layout of FIG. 1, six acoustical panels, 12, with two such panels between two columns, 14, are positioned along each side wall, 16. As more filly viewable in later figures, a column nailer, 15, is secured to points along the structural walls, 5. A viewing screen, 18, is on the front wall, 20. Seats for viewing, shown generally as 22, are advantageously placed in the center of the floor, 30, to obtain greater benefit from the arrangement of speakers (not shown) in the room, and to provide good viewing of the screen, 18, for all viewers. One or more doors, 19, are added per a specific requirement of the existing structure, or the plan of a building re-design, or a newly built structural room. For instance, not to be limiting, a door may be placed in the forward areas of the side walls, 16, or along the back wall, 34. Typically, the door is constructed of sound absorbing materials. FIG. 1 also identifies the soffit lights, 17, which preferably are low voltage type and with dimming capability.

Also, although not shown in FIG. 1, acoustical panels may be positioned in other locations along, such as, the rear wall, the front wall, or the front sections of the side wall that in FIG. 1 do not have acoustical paneling. Experience has shown, however, that a standard, effective placement of acoustical panels in a typical rectangular room, where the seats are arranged as shown in FIG. 1, is to have the closest panel to the front along each wall be a sound-absorbing acoustical panel, then followed by a sound-reflecting acoustical panel, and then followed by four additional sound-absorbing acoustical panels. This has been found to provide, in many dimensions of rooms within a normal range of room sizes, the viewer in the center-seat in the back row with the best sound.

Also, it is noted that in most situations a customer, or end-user, of the present invention will be quite satisfied with the sound based on an arrangement of sound-absorbing and sound-reflecting acoustical panels as described above. However, it is within the scope of the present invention to modify, or customize, the arrangement of panels for a particular room and/or end-user. For instance, techniques such as those known in the art of high-end audiophiles, may be applied in such instances. The article, "Acoustic Room Systems (ARS) Room Treatment," starting on page 119 of *The Absolute Sound*, December 2002 issue, is instructive in such techniques. Where such customizing is to be done, where re-arrangements of the acoustical panels are expected, the panels are set into place without the typical adhesive attachment to the surfaces of the structural walls, and are moved around during the customization. For instance, temporary brackets can hold the tops of the acoustical panels in place during the period of evaluation of different panel arrangements. Then, as for the typical construction, when the customization is complete, adhesive to the walls, plus the columns, plus the baseboard and soffit keep the panels in position.

Alternately to typical use of adhesive, either less adhesive, or no adhesive, may be used in cases where the end-user has a desire to disassemble the components of the present invention and move these to another location after a period of time. The present invention presents this opportunity since a particular arrangement of build-in acoustical panels and bridger structures (e.g., two sets each with five sound absorbing panels, one sound reflecting panel, four columns, and optional soffits and baseboard pieces) is capable of covering a range of wall spans (or widths). Thus, an end-user who, after a period, is moving his or her residence, may choose to remove the components of the present invention and take these to the new residence, even if the room size differs.

Further, typically acoustical panels along the middle and back of the side walls, as described above, is found to be most important for the audio quality of the room. However, this is not meant to limit the utility of the present invention for placement of acoustical panels along the back, or the front wall, which an end-user may desire in a given room. That is, the present invention also is utilizable for the front and/or back walls of an acoustical-paneled room. Where either type of acoustical panel, 12 or 13, is not shown, any type of a standard wall, such as gypsum wallboard, or wood paneling, may be utilized.

Figure 2:
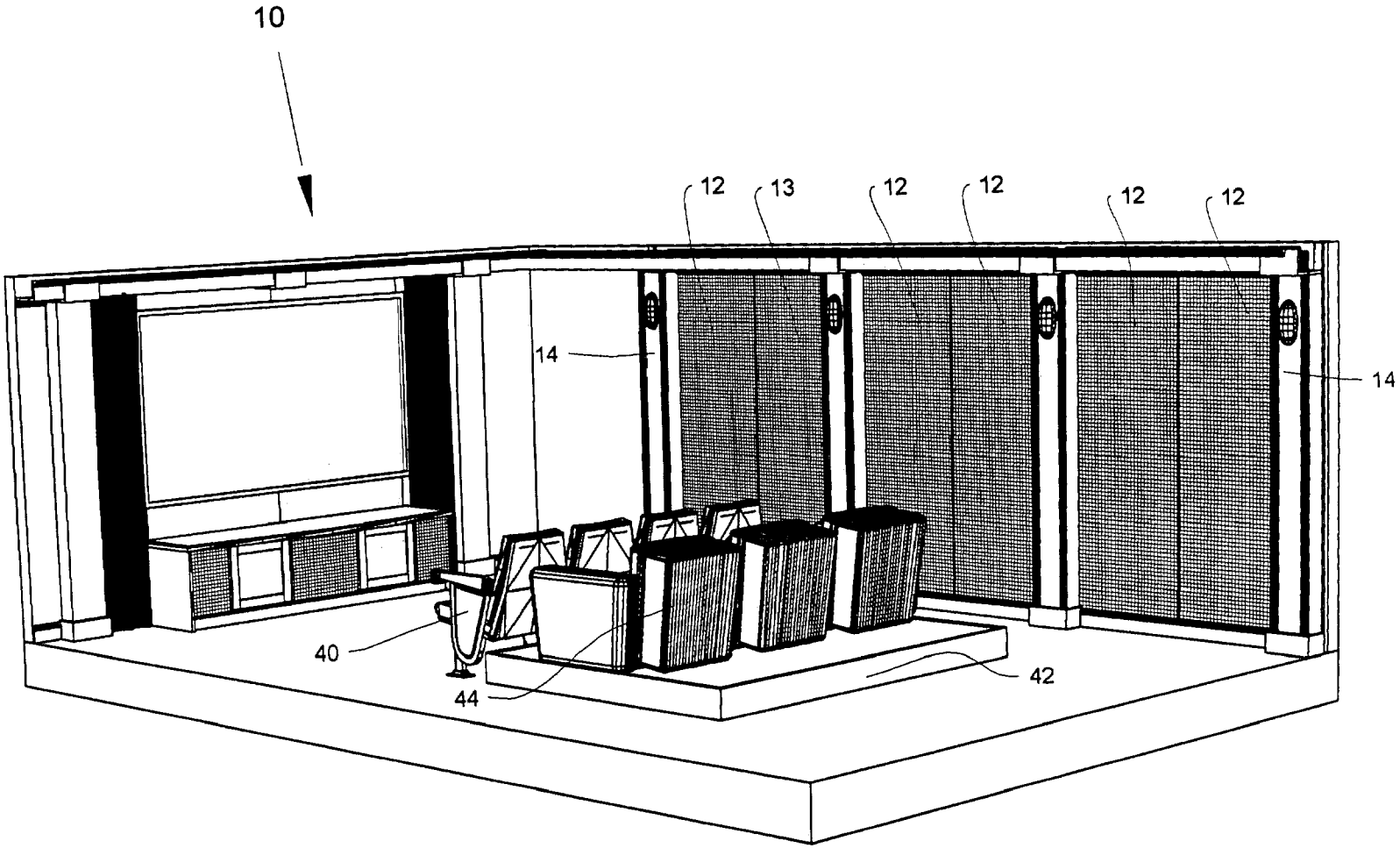
FIG. 2 provides a side perspective view of the front and one side wall of the completed home theater presentation room of FIG. 1, showing one alternative seat arrangement.

FIG. 2 provides a side perspective view of the front and one side wall of the completed home theater presentation room of FIG. 1, showing one alternative seat arrangement. The arrangement of a pair of acoustical panels, 12 with 13 for the first pair, and two 12s for the other pairs, positioned between columns, 14, is more apparent. Seating in this embodiment provides four cinema-type seats, 40, behind which is a riser, 42, upon which are three reclining lounge-type seats, 44. This arrangement has been found to provide good viewing and listening for the average home audience. As noted above, the center seat 44 typically obtains the best sound when the panels are arranged as described for FIG. 1. Other arrangements, numbers, and types of seats are within the scope of the present invention. The riser, 42, may have a wide variety of coverings, moldings, step(s), edging, and other features or detail as desired by the customer.

Figure 3:
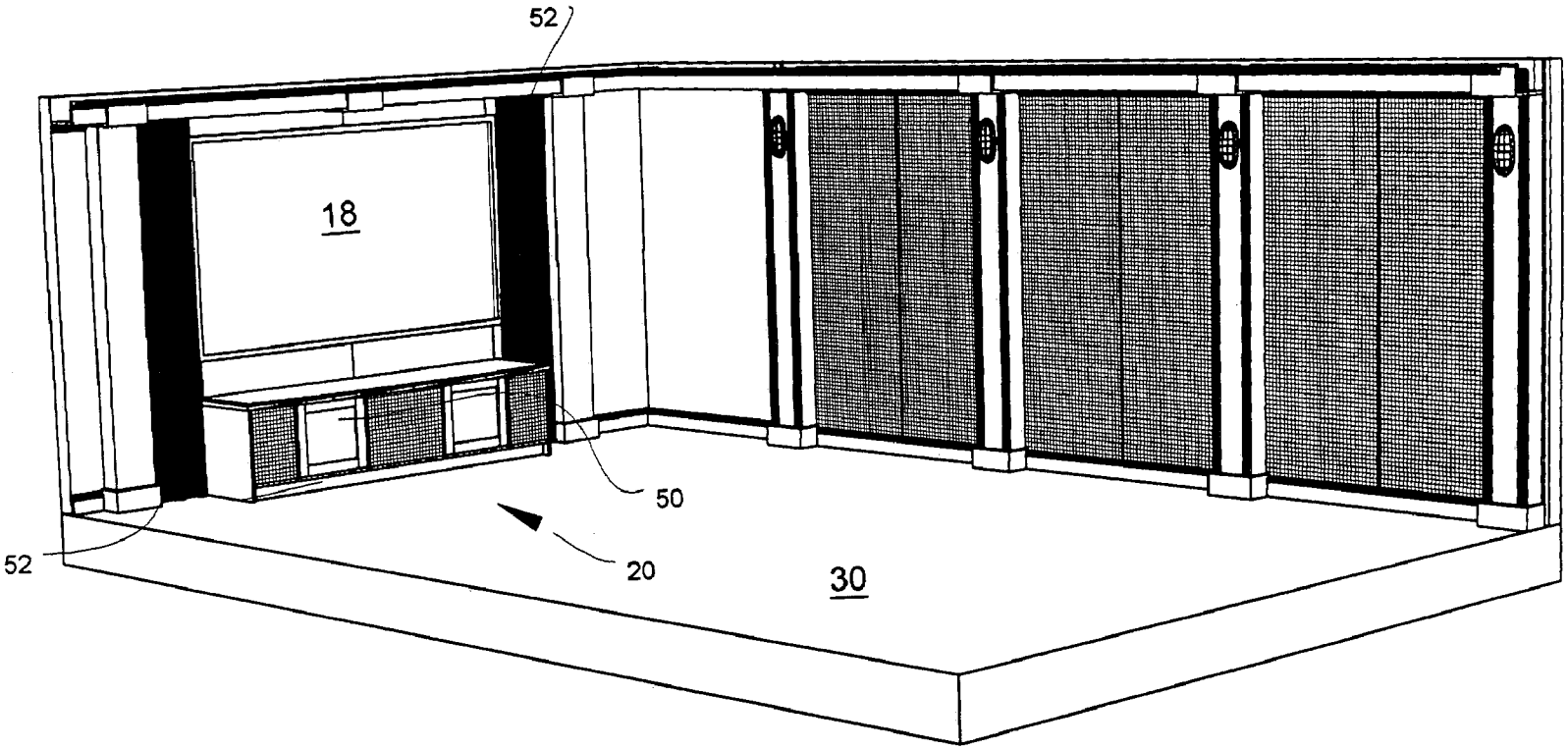
FIG. 3 provides a side perspective view of the front and one side wall of the completed home theater presentation room of FIG. 1, and without seats.

FIG. 3 provides a side perspective view of the front and one side wall of the completed home theater presentation room of FIG. 1, without the seats, 40 and 44, and the riser, 42 (which are shown in FIG. 2). A stereo cabinet, 50, is provided in this embodiment against the front wall, 20, below the viewing screen, 18. The stereo cabinet typically contains the electrical components (not shown), and may also contain a subwoofer (not shown). As appropriate, when a subwoofer is contained near electrical components of the audio or video system, vibration dampers are provided for such components. Wiring from the audio electrical components passes, preferably behind the built-in wall structure, to speakers (not shown) around the room, 10. It is noted that "surround-sound"-type speakers typically are placed on the walls, such as on the acoustical panels, and are bracketed to the structural wall, behind such panel. Also, depending on the type of speaker that the customer desires, one or more main speakers may be placed on the floor, 30, at various optimized positions that depend on the room configuration, the speaker type, the acoustical characteristics of the room, the positions of the listeners and other speakers, and other factors.

Also shown in FIG. 3 are curtains, 52, which are adjusted to the design of the front wall. In FIG. 3, for instance, the curtains, 52, are sized to fit between the viewing screen, 18, and a column, 14. As desired, acoustical panels could be positioned to the outer sides of such front-placed columns, 14. In other embodiments a column on the front wall may be constructed so as to not contain the features of the columns, 14, which are used in the present invention to contain acoustical panels in a manner that provides for fitting the build-in home theater to a range of room sizes.

Figure 4:
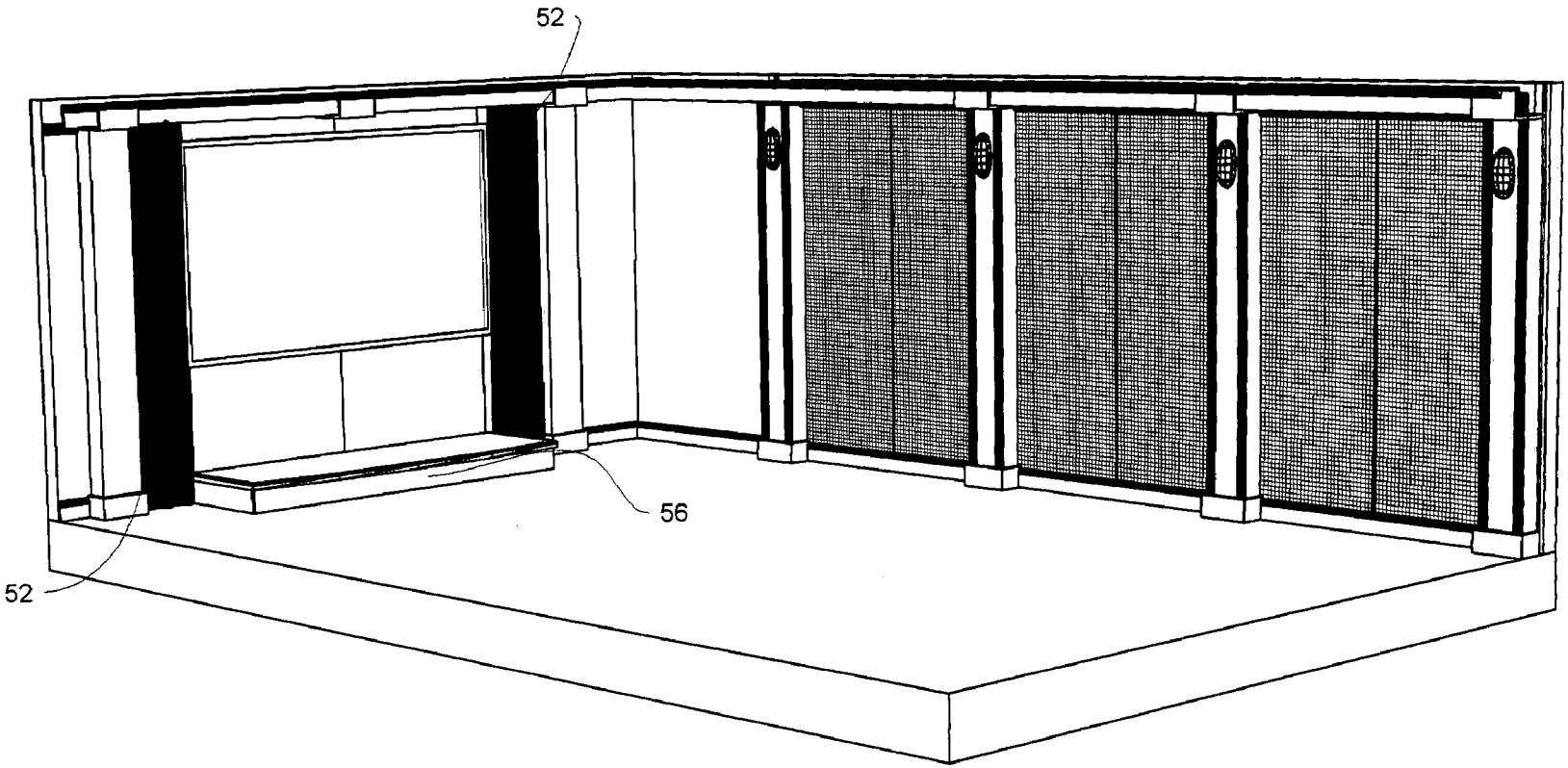
FIG. 4 provides a side perspective view of the front and one side wall of a completed home theater presentation room such as in FIG. 1, without the stereo cabinet shown in FIG. 3.

FIG. 4 provides a side perspective view of the front and one side wall of a completed home theater presentation room, 10, such as in FIG. 1, without the stereo cabinet shown in FIG. 3. In place of the stereo cabinet is a stage, 56. This is not typically of sufficient size for an actual performance, but is meant to provide more of the atmosphere of a large, standard movie theater in a home video presentation room. It is noted that when a front-placed stereo cabinet is not provided, the placement of the audio and video electronics may be anywhere around or near the room, 10. For instance, but not meant to be limiting, the audio and video electronic components may be placed in built-in shelving or cabinets the fronts of which are at or near the plane of a wall. In this case the electronic components actually lie outside the wall planes that define the room space. Wire or other connections link such components to the respective audio and video units (speakers, projector, etc.) that are within the room, preferably by passing behind the built-in home theater panels.

Also, it is noted that the rooms depicted herein are suitable for audiophiles. For instance, superior speakers advantageously placed in the room may provide exceptional listening, given the proper positioning of the acoustical panels throughout the room. As desired, the curtains, 52, may be made functional, that is, may be used to cover the screen when the room is used for listening only.

Figure 5:
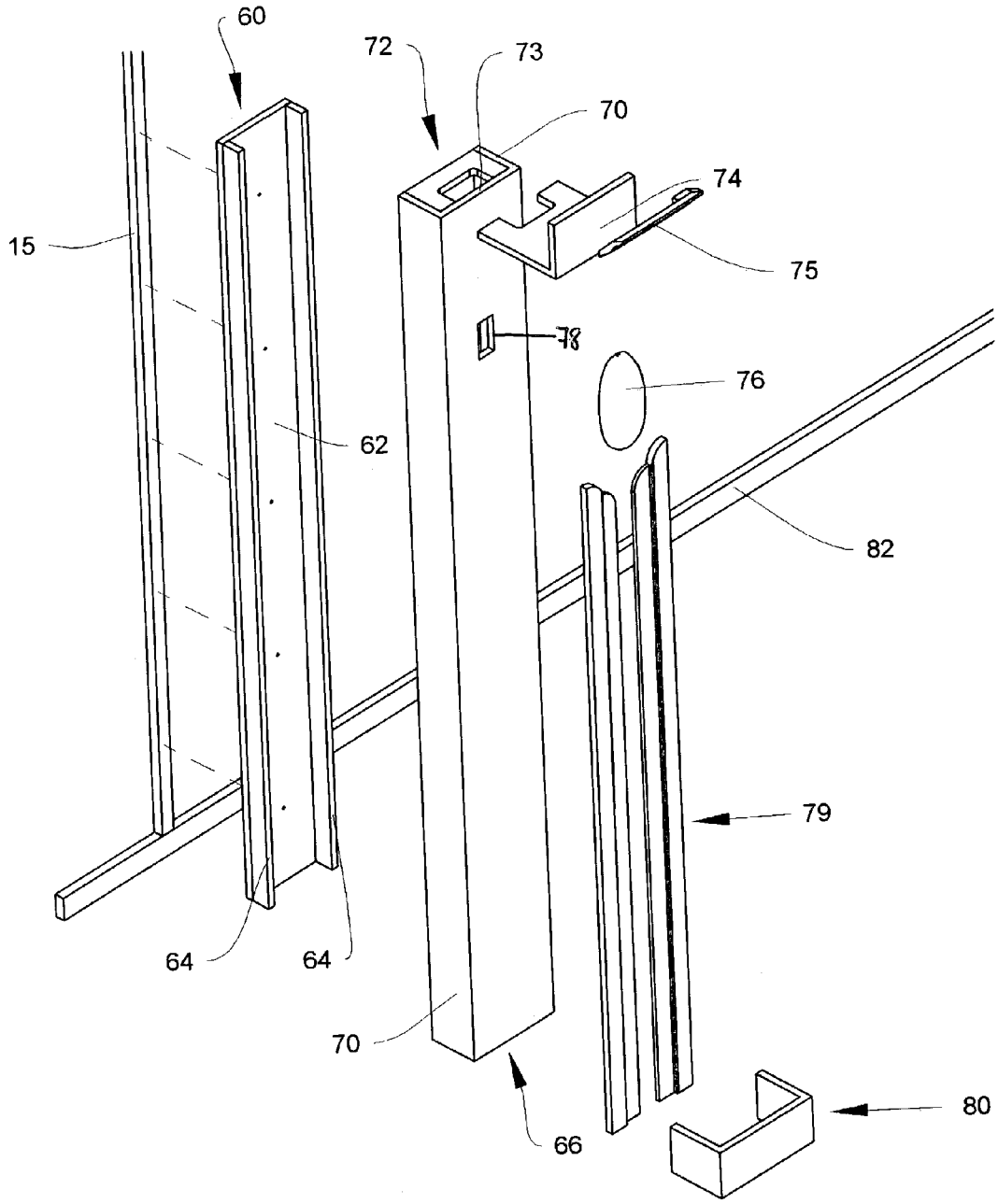
FIG. 5 provides an exploded view of one column assembly of the present invention.

FIG. 5 provides an exploded view of one column, 14, of the embodiment of the present invention as shown in FIGS. 1–4. The column, 14, is comprised of the following component parts, where the set of such component parts are also referred to as a column assembly.

A column bracket, 60, extends substantially the height of an acoustical panel (not shown), has a broad back span, 62, and two inward-projecting struts, 64, positioned at the edges of the broad back span, 62. Thus, in a horizontal cross section, this embodiment of the column bracket, 60, is U-shaped. In typical construction, the column bracket, 60, is fabricated from three pieces of wood that are glued and nailed or screwed together. In alternative constructions, this may be a unitary piece that is extruded or cast using a material, such as, but not meant to be limiting, a plastic, a composite comprising a resin and structural matrix, and a non-ferrous metal.

Also in FIG. 5 is a baseboard column, 66. As for the column bracket, 60, the baseboard column, 66, also extends substantially the height of an acoustical panel (not shown), or higher. The baseboard column, 66, has a broad front face, 68, and two outward-projecting struts, 70, positioned at the edges of the broad front face, 68. Thus, in a horizontal cross section, this embodiment of the front face, 68, is U-shaped. When positioned as shown in the construction of a typical column, 14, of this embodiment, the "U" opens toward the existing wall (not shown), and away from the room. Also, the baseboard column, 66, is sized in relation to column bracket, 60, such that the inner surface, 71, of each of the two outward-projecting struts, 70, comes into contact or close proximity (most preferably in contact, otherwise, within $1/16^{th}$ inch, or, less preferred, within $1/8^{th}$ inch) with the outer surface, 65, of the corresponding (i.e., left or right side) inward-projecting strut, 64, of the column bracket, 60. This provides for facile construction and a sturdy structure once the baseboard column, 66, is slid in place over the column bracket, 60, and fastened, as by nails or screws. This comprises a preferred embodiment which allows for facile fabrication of the column structure, which, advantageously, results in superior structural integrity.

It is noted that in typical construction of this preferred embodiment, the baseboard column, 66, is fabricated from three pieces of wood that are glued and nailed or screwed together. In alternative constructions, this may be a unitary piece that is extruded or cast using a material, such as, but not meant to be limiting, a plastic, a composite comprising a resin and structural matrix, and a non-ferrous metal.

Figure 6:
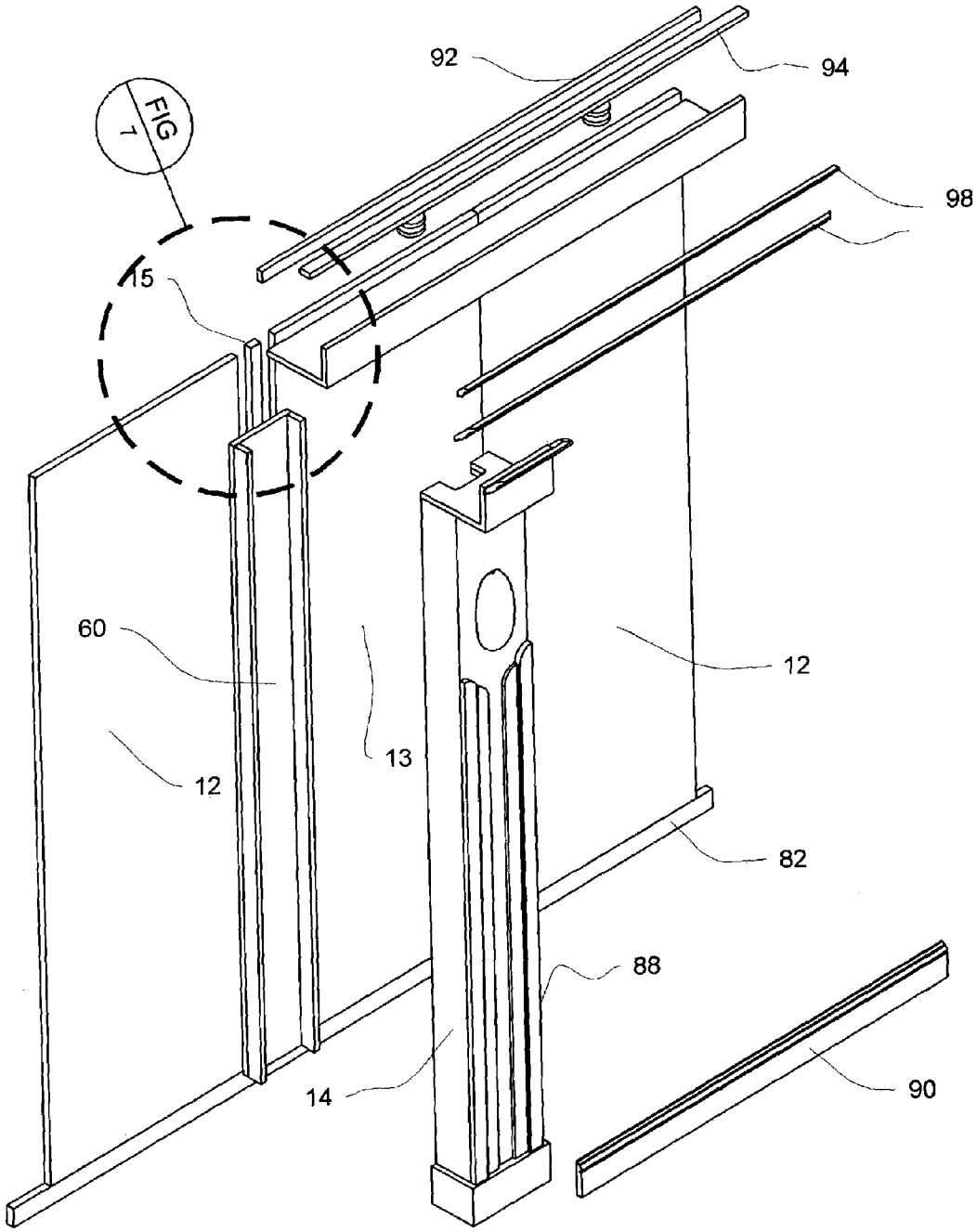
FIG. 6 provides a partially constructed, partially exploded view of one column and two acoustical panels to one side of such column, and one acoustical panel to the other side of such column, of the present invention.
Figure 11:
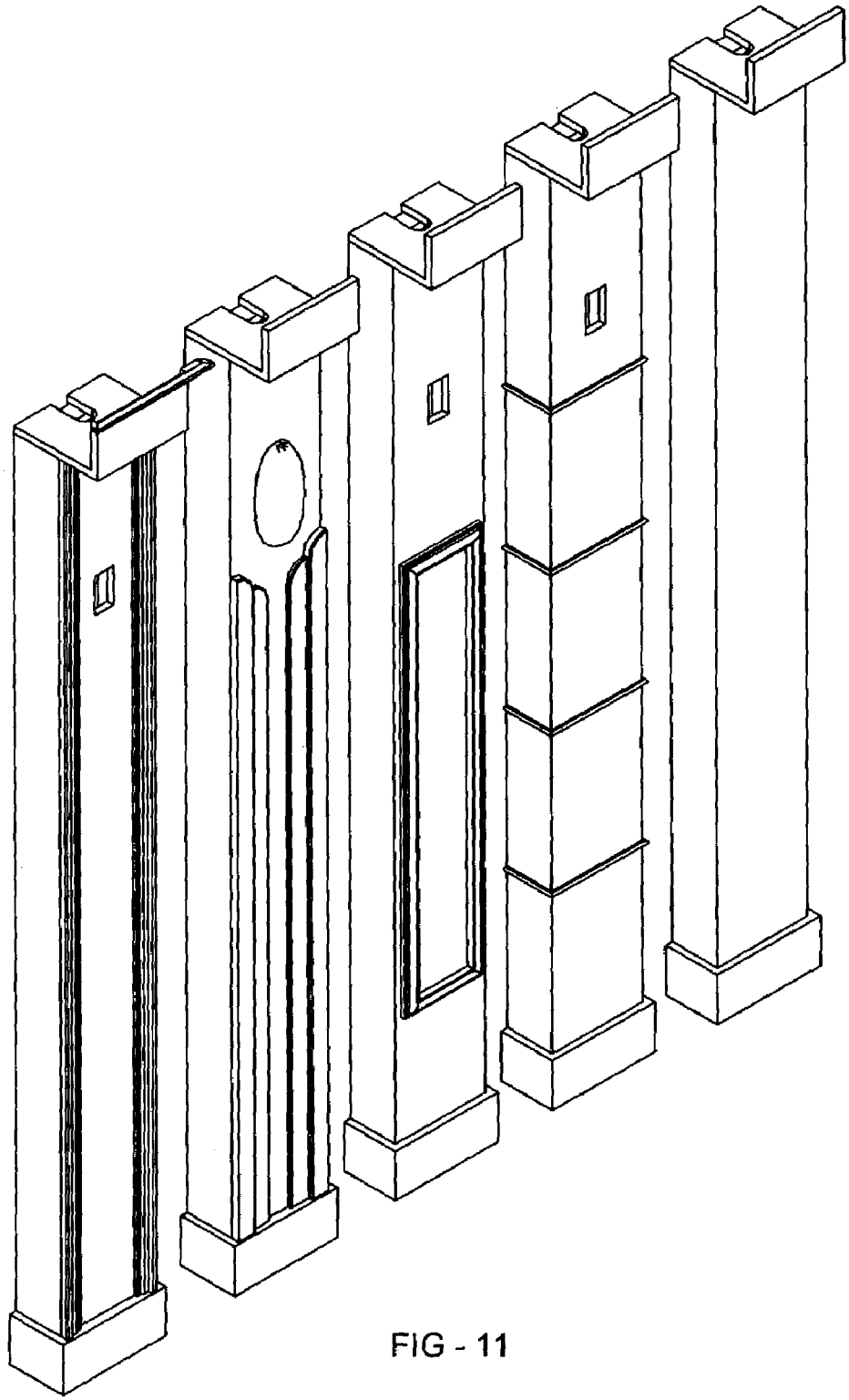
FIG. 11 provides perspective views of five different styles of columns that may be selected for use in the present invention.

The following components are specific to the preferred embodiment depicted in FIGS. 1-4, and are readily varied based on styling and speaker positioning preferences of an installer and/or end user of the acoustical-paneled rooms of the present invention:

1. A top end block, 72, is positioned at or near the top of, and joins, the inner surfaces of the broad front face, 68, and the two outward-projecting struts, 70. Typical joining is by screws or nails, with gluing optional. An electrical chase, 73, is comprised of a void, or space in the top end block, 72. This facilitates passing wiring from above the column, 14, into said column, 14, to supply such wiring for lighting and/or speakers. It is noted that in preferred embodiments, the height of the column bracket, 60, is less than the height of the baseboard column, 66, by a distance sufficient to allow the bottom plane of the top end block, 72, to fit over the top edge of the column bracket, 60. A close fit adds to the structural stability of the assembled column, 14. Also, a bottom end block (not shown), of similar shape (but without the electrical chase), preferably is also attached, within the bottom end of baseboard column, 66. When this is part of the assembly, the column bracket, 60, is secured sufficiently high on the column nailer, 15, to provide clearance for the thickness of the bottom end block (not shown) below it.
2. A column cap, 74, is a covering and decorative piece that is positioned atop the baseboard column, 66. As shown in FIG. 6, the side edges of the column cap, 74, align with a soffit (not shown in FIG. 5).
3. A column cap crown, 75, is a covering and decorative piece that covers the juncture of the column cap, 74, and the ceiling (not shown).
4. A sconce light, 76, is a lighting fixture placed onto the baseboard column, 66, and is positioned over a hole, 78, on the front surface of the baseboard column, 66, through which electrical wires pass to power the light bulb (not shown) within the sconce light.
5. A decorative detail assembly, 79, may comprise any number of individual pieces to provide a desired stylistic flair to the column. In FIG. 5, an art deco style is imparted by the addition of two opposing pairs of feather-like, aligned vertical forms, 79. Other styles may be provided over the front and/or sides of the baseboard column, 66, including styling assemblies that delineate the base, shaft and capital sections of a classic column. Some styles, not meant to be limiting, are shown in FIG. 11.
6. A column base, 80, covers the front and sides of the baseboard column, 66, at and near the bottom of the baseboard column, 66. As inferred immediately above, this can be stylized, such as to match the styling of the decorative detail assembly, 78.

Other decorative pieces, as well as speakers, can be provided to the column, 14, as may be accomplished by one of skill in the art, either instead of, or in addition to, the above-described components.

Also shown is the base nailer, 82, the function of which is described below for FIG. 6.

FIG. 6 provides a partially constructed, partially exploded view of one column, 14, two acoustical panels, each 12, to one side of such column, and one acoustical panel, 12, to the other side of such column. During the erection of the build-in wall of which these components form a part, the column nailer, 15, is fastened, such as by nail, screw or staple (and, optionally, glue), and/or adhesive caulk, to a specific location along the structural wall (not shown in FIG. 6). The specific location, as discussed herein, depends on the configuration of columns (or other selected bridger structure) and panels chosen to cover the particular set of structural walls.

A length of a base nailer, 82, is secured to the wall (not shown), so aligned as to provide a base upon which acoustical panels, 12, thereto attached, will lie substantially coplanar to one another and the adjacent column nailer, 15. Accordingly, each acoustical panel, 12, is secured atop a corresponding section of base nailer, 82, and both are aligned in relation to a gap, 84, that is defined by the edges, 86, of the column bracket, 60. As noted elsewhere in this disclosure, the extent to which one or more panels, 12, occupy such gap is related to the overall span that the columns, 14, and interpositioned panels, 12, are designed to cover along a particular structural wall.

The column bracket, 60, is likewise secured to the column nailer, 15, by a desired means, thus defining the gap, 84. Other components of the column assembly, collectively referred to in FIG. 6 as 88, having been pre-assembled, are positioned over the column bracket, 60.

Also, a baseboard, 90, is secured to cover the junction of the bottom of each acoustical panel, 12, and the base nailer, 82. Also, as shown, a lower soffit nailer, 92 (typically secured to the structural wall, 5), and an upper soffit nailer, 94 (typically secured to the ceiling, not shown), are secured so as to provide structures to which is secured a soffit, 96. In the embodiments depicted in FIGS. 1–6, each section of soffit, 96, covers the top edges of two adjacent acoustical panels, 12, which are positioned between two columns, 14. As previously described, each column, 14, has a column cap, 74, which aligns with or is slightly offset the lateral ends of the adjacent soffits, 96. Also, molding, 98, is provided to cover the junction seams between the top edge of the soffit, 96, and the ceiling (not shown), and the bottom edge of the soffit, 96, and a part of the acoustical panels, 12, that is at or near the top edge of such panels, 12. Thus, the soffit, 96, and molding, 98, present aesthetically attractive finishing touches to the top part of the build-in wall of the embodiment of present invention depicted in FIGS. 1–6. The dimensions of the soffit is variable, depending in part on the overall height of the room, which typically falls within seven to nine feet. Also, the height of the typical acoustical panel, 12 and 13, is eight feet.

It is noted that the space within the soffit, 96, also provides for the positioning of conductive wires, such as to transmit electricity for lighting, and signals for speakers. For instance, when a speaker is placed over a section of an acoustical panel, speaker wires are dropped behind such panel from the soffit, 96, and passed to the speaker.

Also, it is noted that other embodiments within the scope of the present invention combine one or more of the above-described components into a single component. That is, the function of two or more of the above components may be combined into a pre-assembled, or into a unitary, component. Examples, not meant to be limiting, of such consolidation, are provided in FIG. 9C and the accompanying discussion.

Figure 7:
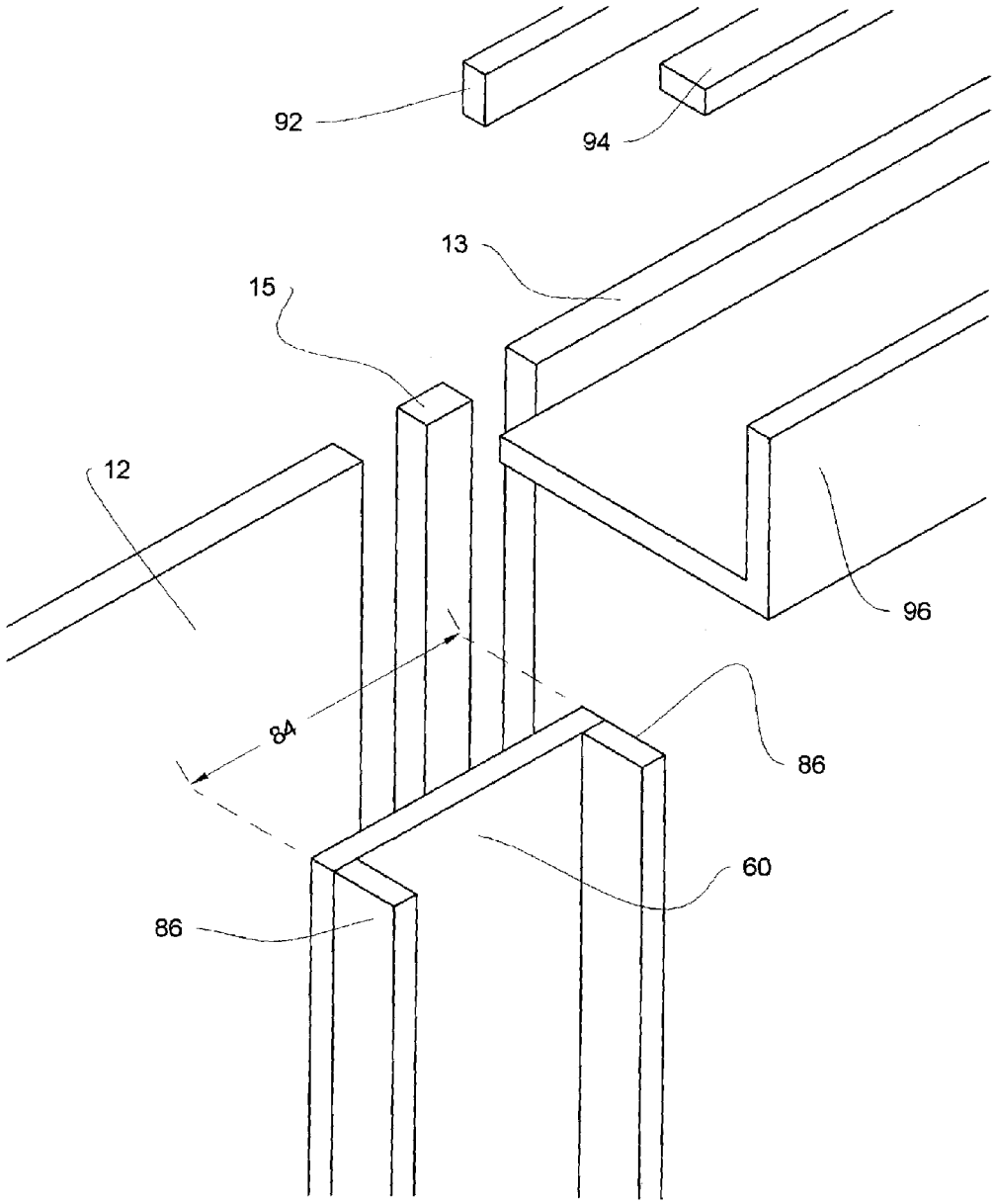
FIG. 7 provides an enlarged view of one part of the gap area behind the column of FIG. 6.

FIG. 7 provides an enlarged view of one part of the gap area behind the column of FIG. 6. This provides a clearer view of the gap, 84, that is defined by the plane of the outer lateral surfaces, 86, of the column bracket, 60. While not preferred, it is noted that an "extended gap" may be defined by the outer lateral edges of the baseboard column (70 in FIG. 5) which, when positioned over the column bracket, 60, is broader than the gap, 84, defined by the column bracket, 60. Also, as more fully discussed below, the position of the column nailer, 15, need not be centered in the gap, 84, although it is so shown, centered, in FIG. 7.

Figure 8:
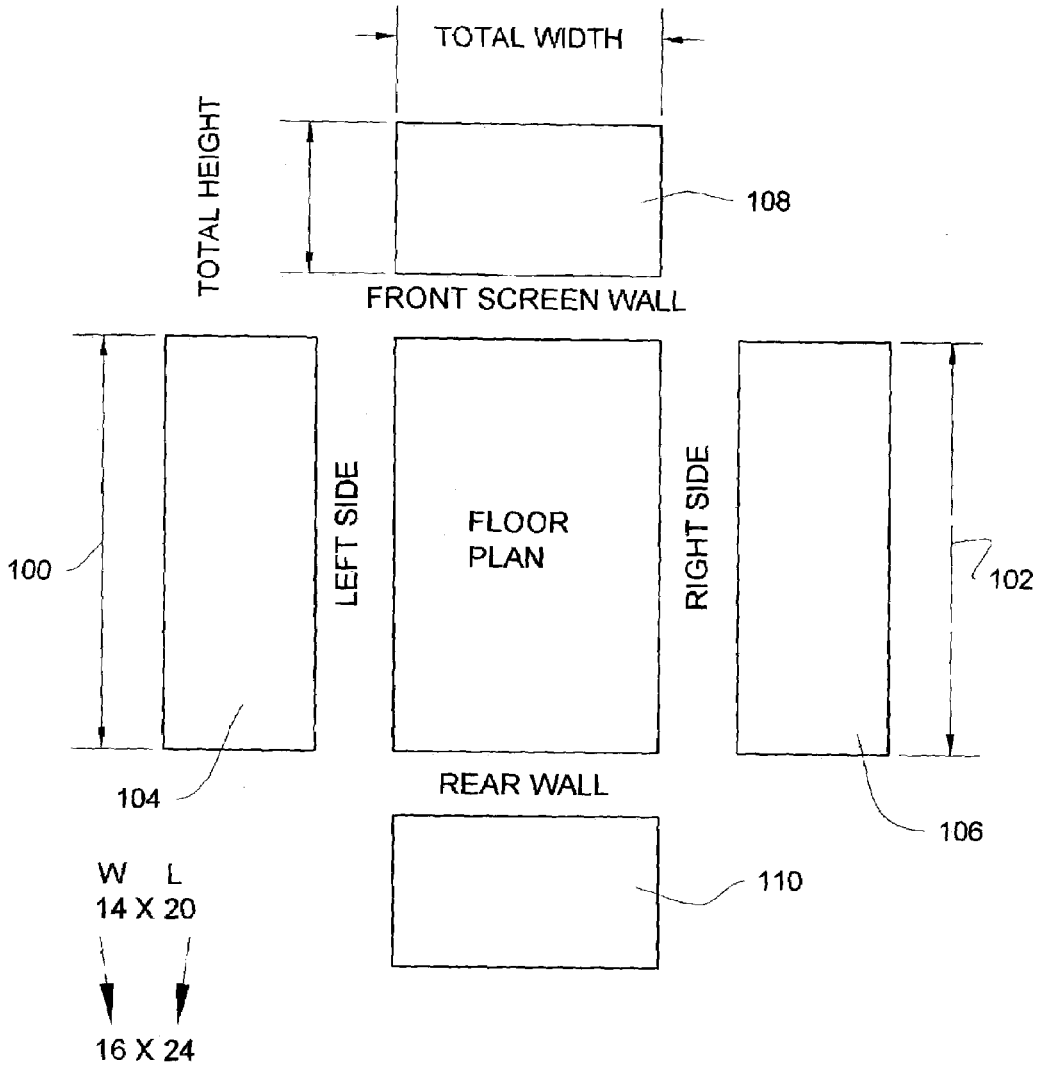
FIG. 8 provides a schematic planar view of the floor and the four walls of the home theater presentation room of FIG. 1.

FIG. 8 provides a schematic planar view of the floor and the four walls of the home theater presentation room of FIG. 1. Typically, but not meant to be limiting to the scope of the present invention, an existing room that is to be converted to a home theater presentation room with the present invention has a room length between 20 and 24 feet. That is, the linear spans of the left side wall, 100, and the right side wall, 102, usually are the same, and typically are between 20 and 24 feet.

In a preferred kit embodiment of the present invention, generally depicted in FIGS. 1–4, each such side wall, 104 and 106, is allotted four column assemblies (not shown in FIG. 8) and six acoustical panels (also not shown in FIG. 8). In such preferred embodiment as shown in FIGS. 1–4, the width of the column bracket, 60, is nine inches, and the width of the column nailer, 15, is 1.75 inches. This means that the allowable gap, or space, 84, that provides variable span for the edges of both acoustical panels, 12, that are to fit behind the column bracket, 60, is approximately seven inches. In that the column nailer, 15, behind the end column assemblies (i.e., the ones that only have one acoustical panel coming behind it) may be spaced anywhere along the nine inch width of the column bracket (see, for example, the arrangement in FIG. 1, where these are placed near the inside column edges, thus maximizing the span coverable), the arrangement of four column assemblies and six acoustical panels as shown in FIGS. 1–4 have the ability to provide approximately 29 inches of variability in the linear wall span that such column assemblies and panels can cover.

This variability provides facile flexibility in the design and erection of the build-in walls of the present invention. For example, and not meant to be limiting, where no non-paneled area is desired or needed along the side walls, the acoustical panels can be inserted to fill only about 0.5 inches of the gaps behind each column assembly, and the four column assemblies and six acoustical panels will cover a span of 20 linear feet. This assumes that the width of each acoustical panel is 34.5 inches, and the other dimensions above apply (the typical panel's height is 96 inches). However, if a room length is less, down to about 17 feet, 8 inches, more of the gaps behind the column assemblies may be filled, and the four column assemblies and six acoustical panels can fill that smaller linear span without the need to cut acoustical panels.

In typical installations, if the linear span (also referred to herein as the width) of the side wall is 20 feet, the gaps are set so that approximately nine inches of side wall to the front and to the rear of the arrangement of panels and columns remains "unpaneled." These nine inches typically are finished as plain gypsum-type drywall. Between wall widths of 20 and almost 22 feet, the gaps are enlarge uniformly to expand the width of the arrangement and still leave about nine inches unpaneled at each end of the side walls. These two unpaneled sections enlarge to about 18 inches as the wall width increases to 24 feet.

Thereafter, if the linear span exceeds 24 feet, several options are available. For instance, as shown in FIGS. 1–4, a larger unpaneled section, such as standard gypsum wallboard (drywall) or non-acoustical wood paneling, can fill a portion of the space (this is shown on the side walls, 16, between the front-most column, 14, and the front wall, 20). Alternately, one or more additional panels (and columns, as needed) can be added to make a larger arrangement.

In summary, depending on the overall objectives of the design and the desired aesthetics, the total span covered by a "standard" arrangement of four column assemblies and six acoustical panels can be varied to meet these objectives, by aligning the column assemblies so that the uncut acoustical panels fill relatively more or less of the gaps behind such column assemblies.

Also, as needed, a doorjamb can occupy the space not covered by the acoustical panels. Alternately, a door could be built where the acoustical panels are to cover an existing wall and door, though this would require a greater amount of custom carpentry.

Further, without limiting the scope of the present invention, it is noted that an existing room that is to be converted to a home theater presentation room with the present invention typically has a room width between 14 and 16 feet. That is, the front screen wall, 108 and the rear wall, 110, typically have a linear span between 14 and 16 feet. An end-user who desires acoustic paneling along the front or rear wall may have this installed, as by the present invention.

Accordingly, although not shown in FIGS. 1–4, embodiments of the present invention may include the assembly of acoustical panels and columns or column assemblies of the present invention to cover the rear wall, and/or to cover parts of the front screen wall that are not occupied by the screen itself. The construction and the advantages are the same as are described herein for covering the side walls.

The above examples discussed are not meant to be limiting. For instance, as noted above, larger rooms may be so long (i.e., have a side wall width so long) as to require more than four column assemblies and six acoustical panels. The present invention covers all quantities of such column assemblies and acoustical panels when used in accordance with the principles and disclosure provided herein. Further, when such construction methods as provided herein are utilized, it may nonetheless be desirable in a particular job to cut one or more of the acoustical panels. This does not bring that installation outside the scope of the present invention.

Thus, it can be appreciated that the present invention provides a flexible and readily modifiable combination of elements for the construction of build-in acoustical-paneled rooms.

Figure 9A:
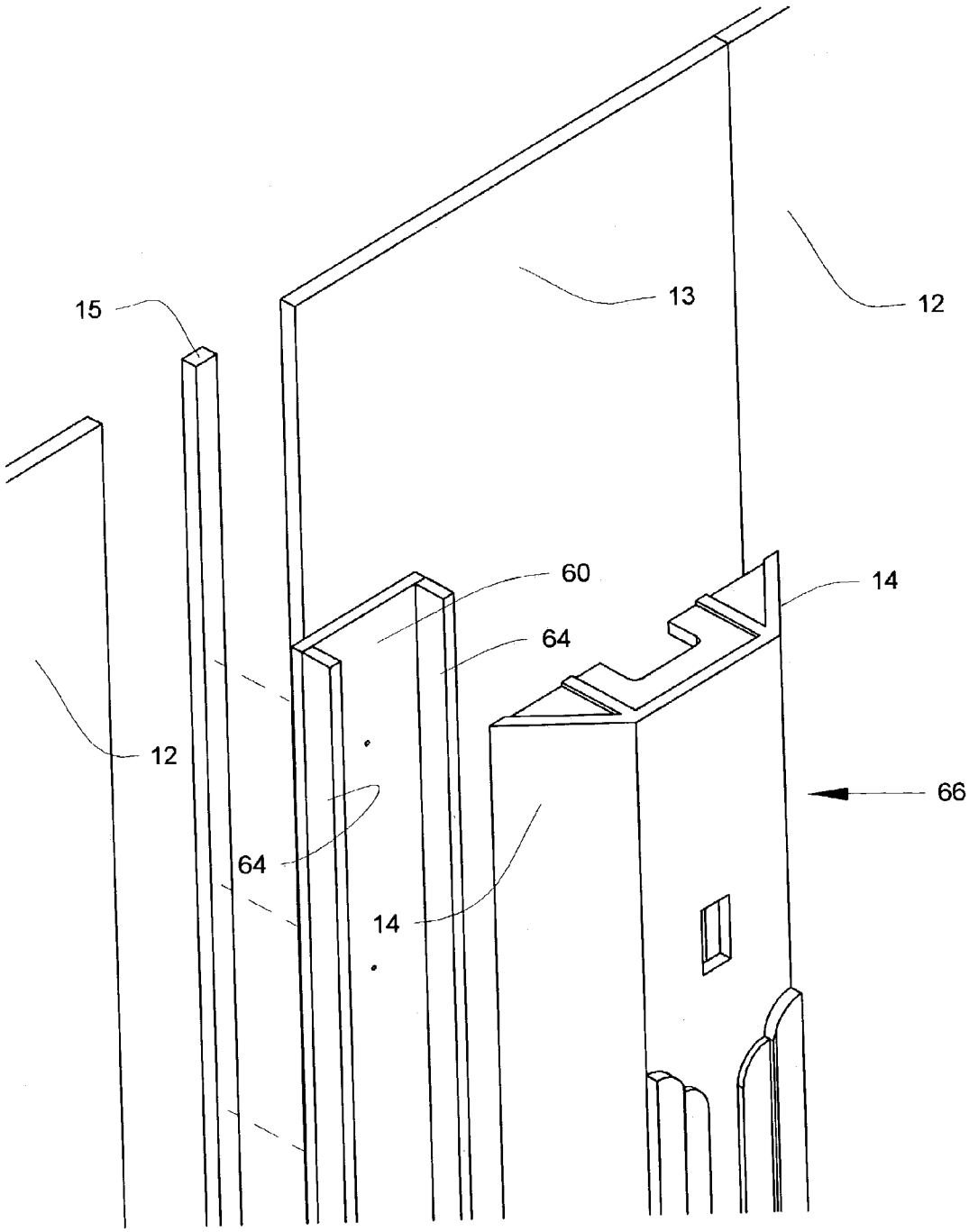
FIGS. 9A–C provide examples of alternative designs of column bracket and column combinations that function effectively in the present invention.
Figure 9B:
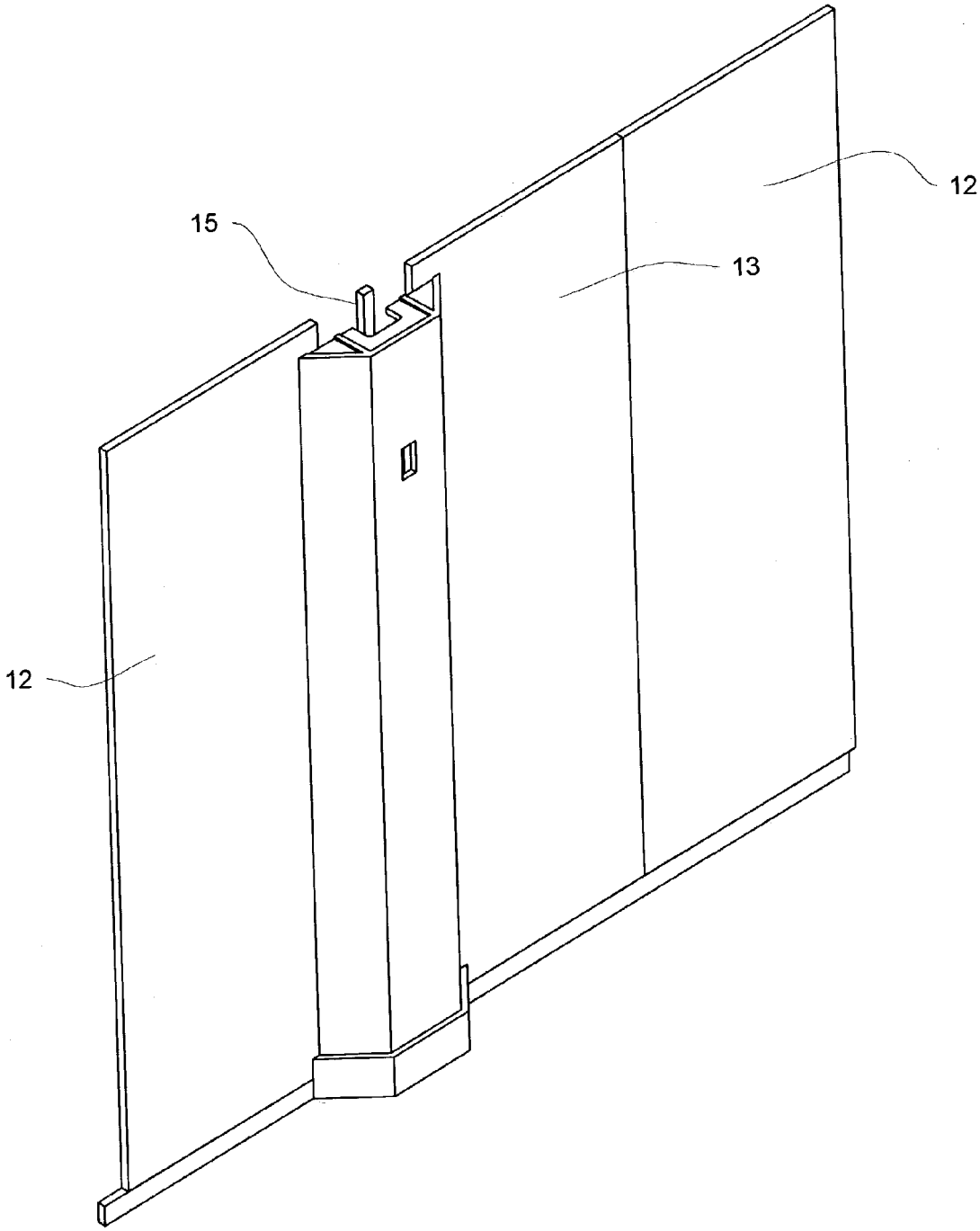
Figure 9C:
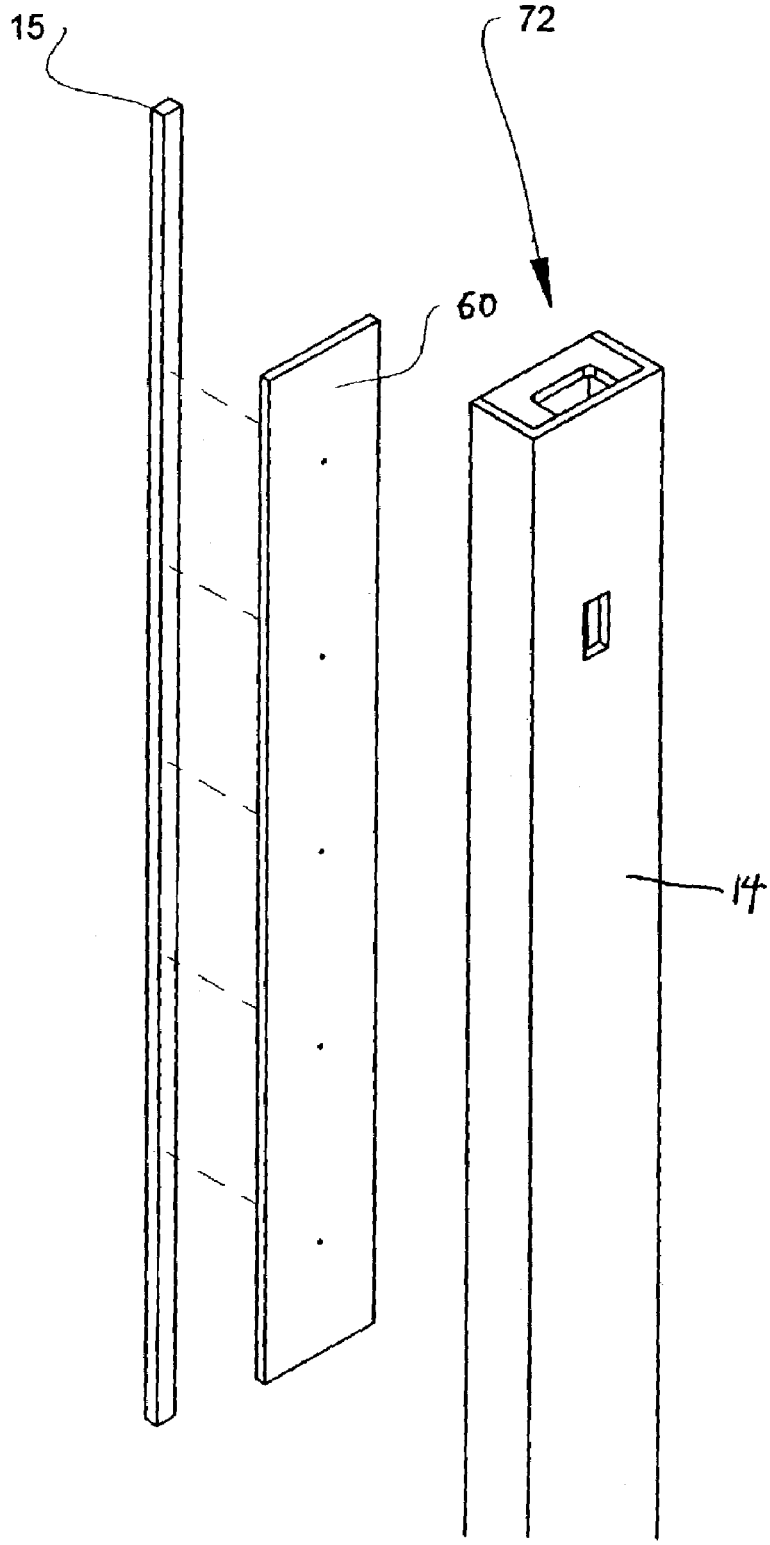

FIGS. 9A–C provide examples of alternative designs of column bracket and column combinations that function effectively in the present invention. FIG. 9A depicts an exploded view of a column assembly, 14, having a cross-section of a truncated triangle. With the broader base toward the panels, 12 and 13, this provides for a wider gap, and accordingly, greater flexibility in sizing a particular arrangement of panels and columns to greater spans of wall widths. FIG. 9B provides a perspective view of this style of column, 14, in place between the adjacent panels, 12 (the 12 in the left foreground of the figure) and 13.

FIG. 9C provides a variation of construction of a column that has a rectangular shape in cross-section. The sides of this column, 14, fit directly over the ends of the simple plank-like column bracket, 60. This allows for more prefabrication of the column, 14, which then is fit over the column bracket, 60.

Other cross-sectional shapes of columns can include semi-circles, triangles, and curvilinear forms, such as are designed to absorb or reflect sound, depending on their position in the room.

Thus, the above is meant to show a range, not meant to be an exclusive or limiting range, of different designs that fall within the scope of the present invention.

Figure 10:
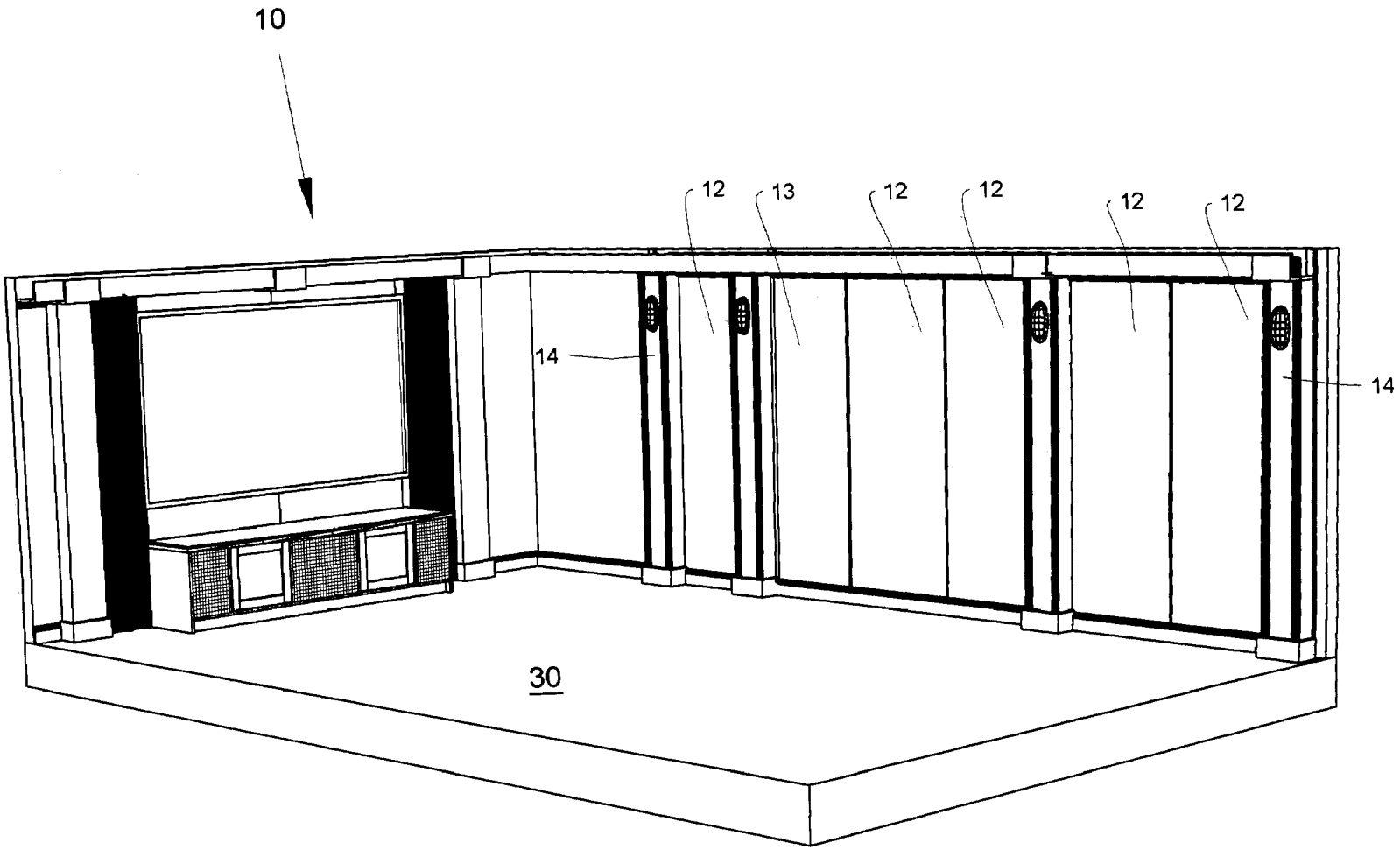
FIG. 10 provides one example of an alternative layout of columns and acoustical panels of a build-in wall of the present invention.

FIG. 10 provides one example of an alternative layout of columns and acoustical panels of a build-in wall of the present invention. From the front to the rear of the arrangement, first two columns, 14, border a single sound-absorbing panel, 12, then the latter of these two columns and the next column borders a sound-reflecting column, 13, and two sound-absorbing columns, 12, and finally, toward the rear wall (not shown), two sound-absorbing columns, 12, are between the latter column, 14, and the rearmost column, 14. This is suggestive of many other variations that are achievable with different combinations of panels, 12 and 13, and columns, 14, to form particular arrangements and sequences for rooms of different sizes.

FIG. 11 provides perspective views of five different styles of columns that may be selected for use in the present invention. These styles of columns is not meant to be limiting. For instance, an alternative style from a geometric standpoint is to have a semi-circular column (i.e., a semi-circle in cross-section) where the radius is coplanar with the front faces of the acoustical panels. Other, more detailed column styles can be found in *The Elements of Style*, revised edition, Stephen Calloway, Ed., Simon & Schuster, 1996. In addition to the methods of the present invention described herein in general and more specific language, and in the claims, Attachment A, which is incorporated by reference in its entirety, is provided as an attachment to this application as filed. As needed, specific aspects of methods from this nine-page set of field instructions for assembly will be incorporated into the present specification.

Further, with regard to kits of the present invention, Attachment B, comprising one page of a "contents" list, is provided as an example of a complete kit of the present invention. The item listed as "Instruction Manual" is comprised of, essentially, the pages that comprise Attachment A.

It is noted that embodiments of the present invention have been installed successfully by a number of different installers, and have found success in the marketplace.

It should be understood that the examples and embodiments described herein are for illustrative purposes only and that various modifications or changes in light thereof will be suggested by this disclosure to persons skilled in the art and in possession of the skill and knowledge attributable to those of ordinary skill in the art. Also, the order in which certain steps of the methods of the present invention may be modified as appropriate to the circumstances without departing from the spirit of the invention. Thus, such modifications or changes are to be included within the spirit and purview of this application and the scope of the appended claims.

Further, and explicitly, none of what is stated herein as "preferred" is considered essential to the present invention in its broader forms and aspects. The preferred implementations of the invention, such as described in the attached figures, in no way limit the scope of the invention. Numerous modifications can thus be made without going beyond the ambit of the invention. The full scope of the present invention must be based on the claims appended hereto, in particular upon the limitations therein and their relationships, while considering the meanings of the terms in such limitations as they would be understood in view of the specification by one experienced in the relevant art.

What is claimed is:

1. A method to erect an arrangement of build-in acoustical panels and bridger structures over a range of wall spans of existing structural walls comprising:

a. juxtaposing a desired number of said acoustical panels along a first desired wall span of a first existing structural wall, said wall having a total width, wherein one or more gaps), each providing a varying gap span, are set between edges of said adjacent acoustical panels; and b. positioning one of said bridger structures, comprising a column bracket positioned within a column over each of said one or more gaps to cover each of said one or more gaps;

wherein a total width of said one or more gaps is based on the difference between said first desired wall span and the combined widths of the acoustical panels that extend across said first desired wall span, and whereby a particular arrangement of build-in acoustical panels and bridger structures is capable of extending across said range of wall spans without a need to cut one or more said acoustical panels to adjust said panels' width(s).

2. The method of claim 1, additionally comprising practicing said juxtaposing and said positioning of claim 1 onto a second desired wall span, of a second existing structural wall, wherein the first and the second wall spans are equal and are covered by two equivalent particular arrangements of said build-in acoustical panels and bridger structures, in a room for use as a home video presentation room.

3. The method of claim 1, wherein said juxtaposing of the acoustical panels covers less than the total width of the first existing structural wall.

4. The method of claim 1, additionally comprising practicing said juxtaposing and said positioning of claim 1 onto a second desired wall span, of a second existing structural wall, having a second specific width, wherein the first and the second wall spans are covered by two non-equivalent arrangements of said build-in acoustical panels and bridger structures, in a room for use as a home video presentation room.

5. A method to erect an arrangement of build-in acoustical panels and bridger structures over a range of wall spans of existing structural walls, comprising:

a. juxtaposing a desired number of said acoustical panels along a first desired wall span of a first existing structural wall, said first existing structural wall having a total width, wherein one or more gaps, each providing a varying gap span, are set between edges of said adjacent acoustical panels;

b. positioning one of said bridger structures over each of said one or more gaps to cover each of said one or more gaps between the edges of said acoustical panels along said first desired wall span wherein said positioning of said bridger structures comprises positioning column assemblies;

c. juxtaposing a desired number of said acoustical panels along a second desired wall span of a second existing structural wall, said second existing structural wall having a total width, wherein one or more gaps, each providing a varying cap span, are set between edges of said adjacent acoustical panels; and d. positioning one of said bridger structures over each of said one or more gaps to cover each of said one or more gaps between the edges of said acoustical panels along said second desired wall span wherein said positioning of said bridger structures comprises positioning column assemblies, wherein a first total width of said one or more caps is based on the difference between said first desired wall span and the combined widths of the acoustical panels that extend across said first desired wall span, whereby a particular arrangement of build-in acoustical panels and bridger structures is capable of extending across said first and said second ranges of wall spans without a need to cut one or more said acoustical panels to adjust said panels' width(s), and wherein the first and the second wall spans are equal and are covered by two equivalent particular arrangements of said build-in acoustical panels and bridger structures, in a room for use as a home video presentation room.

6. The method of claim 5, additionally comprising forming each said column assembly by fining a baseboard column having a U-shape directed toward the wall, over a column bracket having a smaller U-shape directed toward the baseboard column, wherein the side aspects of the respective U-shapes come into contact to provide an improved structural integrity.

7. The method of claim 6, additionally comprising attaching one or more column nailers into the wall, spaced to be attached to each column bracket.

8. An acoustical-paneled room made by the method of claim 7.

9. The method of claim 5, additionally comprising forming each said column assembly by fitting a baseboard column having a U-shape directed toward the wall, over a column bracket having a smaller U-shape directed toward the baseboard column, wherein the side aspects of the respective U-shapes come to be positioned close to one another, to provide an improved structural integrity.

10. A method to erect an arrangement of build-in acoustical panels and bridger structures over a range of wall spans of existing structural walls, comprising:

a. juxtaposing a desired number of said acoustical panels along a first desired wall span of a first existing structural wall, said wall having a total width, wherein one or more gaps, each providing a varying gap span, are set between edges of said adjacent acoustical panels; and b. positioning one of said bridger structures over each of said one or more gaps to cover each of said one or more gaps;

wherein a total width of said one or more gaps is based on the difference between said first desired wall span and the combined widths of the acoustical panels that extend across said first desired wall span, and whereby a particular arrangement of build-in acoustical panel and bridger structures is capable of extending across said range of wall spans without need to cut one or more said acoustical panels to adjust said panels' width(s), and wherein said positioning of said bridger structures comprises positioning column assemblies.

11. The method of claim 10, additionally comprising forming each said column assembly by fitting a baseboard column having a U-shape directed toward the wall, over a column bracket having a smaller U-shape directed toward the baseboard column, wherein the side aspects of the respective U-shapes come into contact to provide an improved structural integrity.

12. The method of claim 11, wherein said juxtaposing of the acoustical panels covers less than the total width of the first existing structural wall.

13. The method of claim 12, additionally comprising finishing one or mare sections of the first existing structural wall not covered by the acoustical panels with an alternative selected from the group consisting of gypsum drywall, non-acoustical wood paneling, and a door jamb.

14. An acoustical-paneled room made by the method of claim 10.

15. The method of claim 10, additionally comprising forming each said column assembly by fitting a baseboard column having a U-shape directed toward the wall, over a column bracket having a smaller U-shape directed toward the baseboard column, wherein the side aspects of the respective U-shapes come to be positioned close to one another, to provide an improved structural integrity.

16. A method to erect an arrangement of build-in acoustical panels and bridger structures over a range of wall spans of existing structural walls, comprising:

a. juxtaposing a desired number of said acoustical panels along a first desired wall span of a first existing structural wall, said wall having a total width, wherein one or more gaps, each providing a varying gap span, are set between edges of said adjacent acoustical panels; and b. positioning one of said bridger structures over each of said one or more gaps to cover each of said one or more gaps;

wherein a total width of said one or more gaps is based on the difference between said first desired wall span and the combined widths of the acoustical panels that extend across said first desired wall span, and whereby a particular arrangement of build-in acoustical panels and bridger structures is capable of extending across said range of wall spans without a need to cut one or more said acoustical panels to adjust said panels' width(s), wherein said juxtaposing of the acoustical panels covers less than the total width of the first existing structural wall, and additionally comprising finishing one or more sections of the first existing structural wall not covered by the acoustical panels with an alternative selected from the group consisting of gypsum drywall, non-acoustical wood paneling, and a door jamb.

* * * * *